US009190722B2

(12) United States Patent
Ryu et al.

(10) Patent No.: US 9,190,722 B2
(45) Date of Patent: Nov. 17, 2015

(54) ANTENNA LINE PROTECTION DEVICE

(71) Applicant: ELECTRONICS AND TELECOMMUNICATIONS RESEARCH INSTITUTE, Daejeon (KR)

(72) Inventors: Seung-Kab Ryu, Daejeon (KR); Kyung-Hoon Lee, Daejeon (KR); Kwang-Uk Chu, Daejeon (KR); Uijung Kim, Daejeon (KR); Up Namkoong, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 14/321,407

(22) Filed: Jul. 1, 2014

(65) Prior Publication Data

US 2015/0011121 A1 Jan. 8, 2015

(30) Foreign Application Priority Data

Jul. 5, 2013 (KR) ..... 10-2013-0079191
Oct. 18, 2013 (KR) ..... 10-2013-0124714

(51) Int. Cl.

| | |
|---|---|
| ***H01R 13/648*** | (2006.01) |
| ***H01Q 1/50*** | (2006.01) |
| ***H01P 1/30*** | (2006.01) |
| *H01P 5/02* | (2006.01) |

(52) U.S. Cl.
CPC .. *H01Q 1/50* (2013.01); *H01P 1/30* (2013.01); *H01P 5/026* (2013.01)

(58) Field of Classification Search
CPC ..... H01R 13/53; H01P 1/30; H01P 5/026; H01Q 1/50
USPC ..... 439/607.01
See application file for complete search history.

(56) References Cited

U.S. PATENT DOCUMENTS

| | | | | |
|---|---|---|---|---|
| 2008/0165466 | A1 | 7/2008 | Gritter et al. | |
| 2011/0304945 | A1 | 12/2011 | Podporkin et al. | |
| 2015/0004847 | A1 * | 1/2015 | Namkoong et al. | 439/638 |

FOREIGN PATENT DOCUMENTS

| | | | |
|---|---|---|---|
| KR | 20-0130536 | Y1 | 12/1998 |
| KR | 10-2012-0037156 | A | 4/2012 |
| KR | 10-2012-0037165 | A | 4/2012 |
| KR | 10-2012-0058442 | A | 6/2012 |

* cited by examiner

*Primary Examiner* — Javaid Nasri
(74) *Attorney, Agent, or Firm* — LRK Patent Law Firm

(57) ABSTRACT

An antenna line protection device includes a pair of coaxial connectors and a streamer discharge module. The pair of coaxial connectors are disposed on both side ends of the antenna line protection device. The streamer discharge module is coupled between the coaxial connectors so that, when a pulse signal is input via the coaxial connectors, the streamer discharge module induces an electric field and thus establishes a discharge current channel, thereby suppressing an excessive input pulse.

13 Claims, 13 Drawing Sheets

ANTENNA LINE PROTECTION DEVICE

CROSS REFERENCE TO RELATED APPLICATIONS

This application claims the benefit of Korean Patent Application Nos. 10-2013-0079191 and 10-2013-0124714, filed on Jul. 5, 2013 and Oct. 18, 2013, respectively, which are hereby incorporated by reference herein in their entirety.

BACKGROUND OF THE INVENTION

1. Technical Field

The present disclosure relates to an antenna line protection device for protecting the electronic elements and devices of an antenna line from high-power electromagnetic wave pulses and, more particularly, to an antenna line protection device that is capable of providing high-power signal limiting performance at a response speed equal to or shorter than a nanosecond using a streamer discharge principle in order to protect the electronic parts of the antenna line of a wireless communication system from a high-power electromagnetic pulse (EMP) or an intentional electromagnetic interference (IEMI) signal.

2. Description of the Related Art

In general, semiconductor parts used in radar systems are very sensitive. Accordingly, such semiconductor parts may be easily damaged by, in particular, electromagnetic waves.

Such semiconductor parts are vulnerable to the influence of a high-power EMP, a high-power microwave (HAM) pulse and an ultra wide band (UWB) pulse.

Accordingly, military and civil communication systems including electronic equipment unprotected from the above-described pulses may be rendered useless due to equipment that generates such pulses.

Therefore, there is a need for measures for protecting vulnerable communication equipment from such pulses.

U.S. Patent Application Publication No. 2008-0165466 discloses an antenna line protection device in which carbon nanotube C-based streamer electrodes S having a sub-nanosecond response time are implemented on a transmission line, thereby protecting a radio frequency (RF) line from high-power electromagnetic waves. FIGS. 1A and 1B illustrate the conventional carbon nanotube antenna line protection device having a sub-nanosecond response speed.

In the conventional technology, the arrayed needle-type streamer electrodes connected to the ground are spaced apart from the center electrode of the transmission line by a specific distance. When a high-power electromagnetic pulse is input to the transmission line, a high-intensity electric field is generated between the arrayed needle electrodes connected to the ground plate and the center electrode. Accordingly, insulation breakdown is generated across an internal air layer, and thus a high power signal is discharged to the ground.

SUMMARY OF THE INVENTION

At least one embodiment of the present invention is intended to provide an antenna line protection device that includes a streamer discharge module coupled between a pair of coaxial connectors and configured to suppress an excessive input pulse, thereby achieving a discharge tube response speed equal to or shorter than a nanosecond.

At least one embodiment of the present invention is intended to provide an antenna line protection device in which a cone-shaped impedance matching unit is disposed inside the coaxial connector between the inner circumferential surface of a through hole and the outer circumferential surface of a first center electrode, thereby overcoming impedance mismatch between a commercial N-connector using a dielectric, such as a Teflon, and a coaxial line using air as a dielectric.

At least one embodiment of the present invention is intended to provide an antenna line protection device in which modularized streamer discharge modules configured to generate a streamer discharge are provided, thereby enabling a plurality of modularized streamer discharge modules to be disposed between a pair of coaxial connectors.

In accordance with an aspect of the present invention, there is provided an antenna line protection device, including a pair of coaxial connectors disposed on both side ends of the antenna line protection device; and a streamer discharge module coupled between the coaxial connectors so that, when a pulse signal is input via the coaxial connectors, the streamer discharge module induces an electric field and thus establishes a discharge current channel, thereby suppressing an excessive input pulse.

Each of the coaxial connectors may include a body part provided with a through hole extending from a first end of the body part through the body part to a second end thereof, and a flange extending along an outer periphery of the second end of the body part; an input/output interface part provided at the first end of the body part, and provided with a connector protruding in a direction corresponding to that of the body part; a dielectric part formed to protrude from the input/output interface part in a direction corresponding to that of the connector and to be inserted into a first end of the through hole; and a first center electrode disposed inside the through hole, formed to extend in a longitudinal direction of the through hole, and configured such that a first end of the first center electrode is connected to the dielectric part and a fastening hole is formed at a second end of the first center electrode to allow a fastening member to be fastened into the fastening hole.

The dielectric part may be configured such that a portion of the dielectric part to which the first center electrode is connected is stepped and protrudes.

The through hole may be formed in a tapered shape such that a diameter thereof remains uniform through a portion near the first end of the body part and then increases in a direction toward the second end of the body part.

The first center electrode may be formed in a tapered shape such that a diameter thereof remains uniform and then increases in a direction toward a second end thereof.

The antenna line protection device may further include an impedance matching part, the impedance matching unit being provided such that an outer circumferential surface thereof comes into close contact with a circumferential surface of the through hole, a first end of an inner circumferential surface thereof surrounds the first end of the first center electrode, and a second end of the inner circumferential surface thereof is spaced apart from the first center electrode and forms a space along with the second end of the first center electrode.

The antenna line protection device may further include a connection portion configured to protrude from the first end of the first center electrode and to be inserted into the dielectric part.

The connection portion may have across-shaped section.

The streamer discharge module may include a casing configured such that a coaxial line is disposed across a center thereof; and a streamer electrode provided inside the casing to be spaced apart from the second center electrode of the coaxial line.

The streamer electrode may include a location adjustment bolt fastened through an outer circumferential surface of the casing; and a cover provided on the outer circumferential surface of the casing, and configured to surround a head of the location adjustment bolt protruding through the outer circumferential surface of the casing.

The streamer discharge module may include a plurality of streamer discharge modules between the pair of coaxial connectors.

The antenna line protection device may further include a spacing module configured to space a plurality of streamer discharge module apart from each other and provided between each pair of the plurality of streamer discharge modules.

The spacing module may include a casing that is configured such that a coaxial line including the second center electrode passes through a center of the spacing module and the casing surrounds an outer surface of the coaxial line.

The antenna line protection device may further include a pair of donut-shaped dielectric rings provided around the outer surface of the second center electrode to be spaced apart from each other and provided such that tips of the streamer electrodes come into contact the pair of dielectric rings.

The streamer electrode may have a cone shape so that a tip of the streamer electrode proximate to the second center electrode has a gradually curved shape.

The streamer electrode may have a needle shape.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1A:
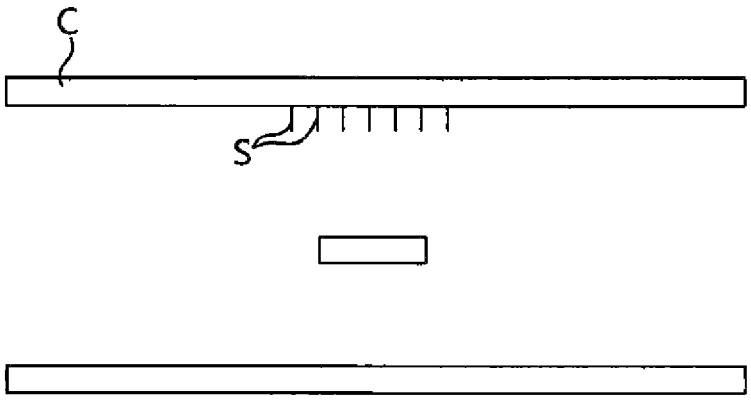
FIG. 1A (RELATED ART)
FIGS. 1A and 1B are diagrams of a conventional carbon nanotube antenna line protection device having a sub-nanosecond response speed.
Figure 1B:
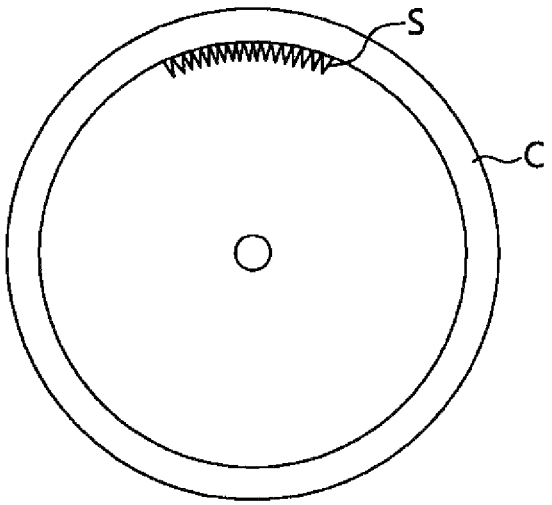
FIG. 1B (RELATED ART)

Embodiments of the present invention are described in detail below with reference to the accompanying drawings. Repeated descriptions and descriptions of known functions and configurations which have been deemed to make the gist of the present invention unnecessarily obscure will be omitted below. The embodiments of the present invention are intended to fully describe the present invention to a person having ordinary knowledge in the art to which the present invention pertains. Accordingly, the shapes, sizes, etc. of components in the drawings may be exaggerated to make the description clear.

The present invention is directed to an antenna line protection device for protecting the antenna line of a wireless communication system from high-power electromagnetic pulses or intentional electromagnetic wave interference signals.

For this purpose, a gas discharge tube has been used so far. However, the gas discharge tube cannot eliminate a high-power electromagnetic pulse having a very fast nano-second rise time because even though the gas discharge tube can handle very high power, it has a low response speed.

Meanwhile, a semiconductor limiter used to limit a jamming signal in a wireless communication equipment or power generated by a transmission signal coupled to a reception unit in an integrated transmission and reception radar apparatus has the advantages of a fast response speed and a high operating frequency, but is disadvantageous in that it cannot eliminate a high-power electromagnetic pulse signal of several tens of kW or higher because its maximum available power level is several kW or lower on a 1 us pulse width basis.

Figure 2A:
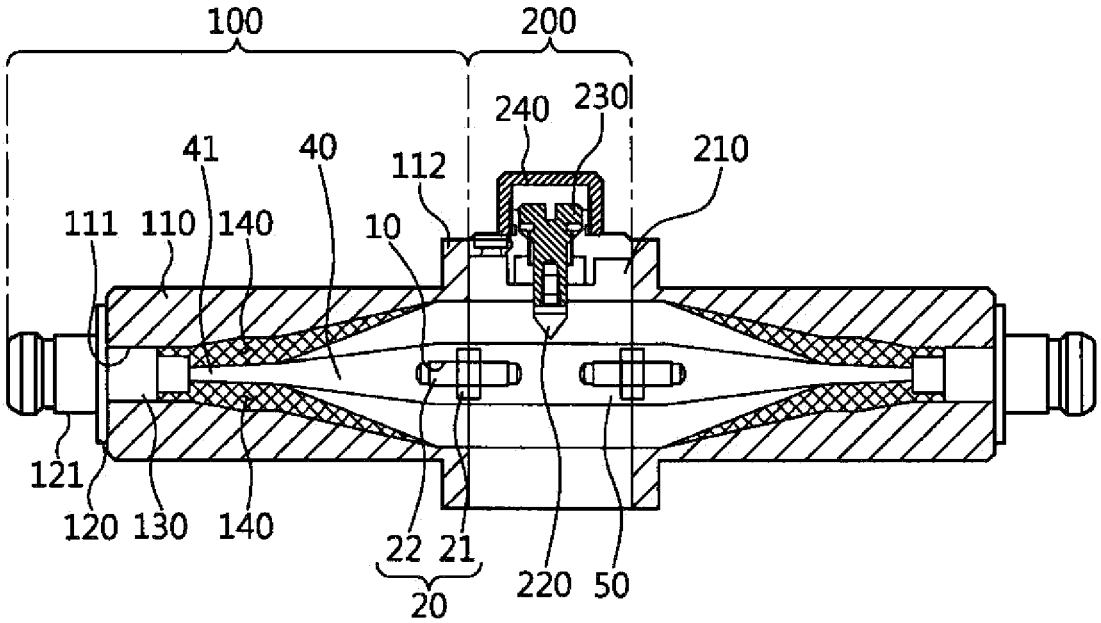
FIGS. 2A and 2B are drawings of antenna line protection devices according to embodiments of the present invention.
Figure 2B:
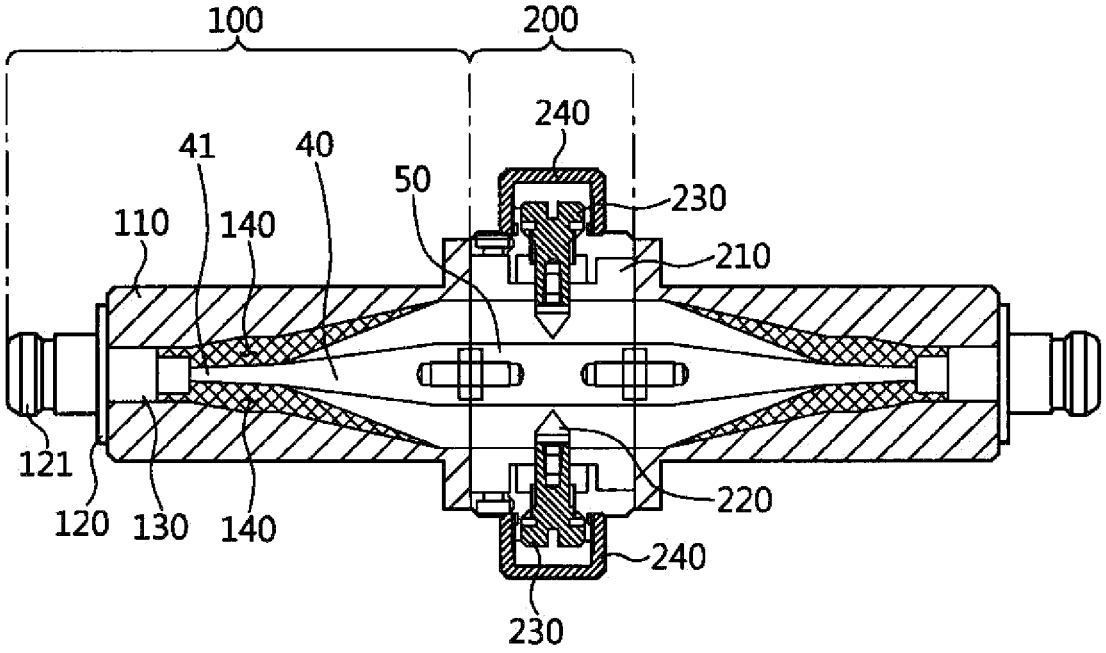

FIGS. 2A and 2B are drawings of antenna line protection devices according to embodiments of the present invention.

The antenna line protection devices according to these embodiments of the present invention are described with reference to FIGS. 2A and 2B. Each of the antenna line protection devices according to these embodiments of the present invention includes a pair of coaxial connectors 100 provided at both ends of the antenna line protection device, and a streamer discharge module 200 coupled between the coaxial connectors 100. The antenna line protection devices operate in such a way that when a pulse signal is input via the coaxial connector 100, the streamer discharge module 200 induces an electric field and thus forms a discharge current channel, thereby suppressing excessive input pulses.

The antenna line protection devices illustrated in FIGS. 2A and 2B may achieve a response speed of a nanosecond or lower using a discharge tube method and a streamer discharge principle having excellent high-power signal limiting capability.

The antenna line protection devices according to these embodiments of the present invention may include a single streamer electrode 220 in the streamer discharge module 200, as illustrated in FIG. 2A, or may include a pair of streamer electrodes 220, as illustrated in FIG. 2B.

The antenna line protection devices are described in greater detail. Each of the coaxial connectors 100 includes a body part 110 provided with a through hole 111 extending from a first end of the body part 110 through the body part 110 to a second end thereof, and a flange 112 extending along the outer periphery of the second end of the body part 110; an input/output interface part 120 provided at the first end of the body part 110, and provided with a connector 121 protruding in a direction corresponding to that of the body part 110; a dielectric part 130 formed to protrude from the input/output interface part 120 in a direction corresponding to that of the connector 121 and to be inserted into the first end of the through hole 111; and a first center electrode 40 disposed inside the through hole 111, formed to extend in the longitudinal direction of the through hole 111, and configured such that the first end of the first center electrode 40 is connected to the dielectric part 130 and a fastening hole 10 is formed at the second end of the first center electrode 40 to allow a fastening member 20 to be fastened into the fastening hole.

In the present invention, the input/output interface part 120 may be implemented as one selected from between a commercial N-connector 121 and a commercial HN-connector 121, which are commonly and widely used.

The body part 110 forms the outer shape of the coaxial connector 100. The through hole 111 that extends from the first end of the body part 110 to the second end thereof is formed through the inside of the body part 110.

In particular, the through hole 111 is formed in a tapered shape such that the diameter thereof remains uniform through a portion near the first end of the body part 110 and then increases in a direction toward the second end of the body part 110.

The portion of the through hole 111 near the first end thereof is formed to have a uniform diameter so that the dielectric part 130 can be inserted thereinto and secured therein.

The dielectric part 130 protrudes in a direction opposite the input/output interface part 120 and the protruding portion of the dielectric part 130 is stepped, so that the center electrode of a coaxial line 30 and the external cable are connected via the input/output interface part 120, thereby achieving the effect of improving insulation performance.

The first end of the first center electrode 40 is connected to the dielectric part 130, and the fastening hole 10 is formed at the second end thereof to be coupled with the fastening member 20.

The first center electrode 40 is formed in a tapered shape such that the diameter thereof remains uniform and then increases in a direction toward the second end thereof in the same manner as the through hole 111.

An impedance matching part 140 is provided such that the outer circumferential surface thereof comes into close contact with the circumferential surface of the through hole 111, the first end of the inner circumferential surface thereof surrounds the first end of the first center electrode 40, and the second end of the inner circumferential surface thereof is spaced apart from the first center electrode 40 and forms a space along with the second end of the first center electrode 40.

The impedance matching part 140 is formed of a dielectric, such as Teflon, and heterogeneous dielectrics are formed, as in the dielectric part 130 and the impedance matching part 140.

If a dielectric other than air is used when a diode is installed on the coaxial line 30, it is difficult to install the diode, and thus it is preferable to employ the coaxial line 30 using air as a dielectric. Heterogeneous dielectrics are formed, as in the dielectric part 130 and the impedance matching part 140, and thus the impedance mismatch between the heterogeneous dielectrics, that is, a Teflon dielectric and air, of the coaxial line 30 can be overcome.

A connection portion 41 that protrudes from the first end of the first center electrode 40 and is inserted into the dielectric part 130 is provided at the first end of the first center electrode 40.

The connection portion 41 has a cross-shaped section. A cross-shaped hole is formed at the second end of the dielectric part 130 so that the connection portion 41 can be fitted into the dielectric part 130.

The streamer discharge module 200 generates a streamer discharge phenomenon between the coaxial connectors 100. The streamer discharge module 200 includes a casing 210 configured such that the coaxial line 30 is disposed through the center of the casing 210 and the streamer electrode 220 provided inside the casing 210 to be spaced apart from the second center electrode 50 of the coaxial line 30.

Since the streamer electrode 220 is spaced apart from the second center electrode 50, air insulation breakdown occurs between the tip of the streamer electrode 220 and the second center electrode 50 when high-power electromagnetic pulses are input to the coaxial cable.

The distance between the streamer electrode 220 and the second center electrode 50 is in the range from longer than 0 um to shorter than 1000 um. The spacing acts as negligible capacitance between the second center electrode 50 and the ground in the case of a small-power input signal, and initiates a plasma discharge within a reaction time of a nanosecond or less in the case of a 1 kW or higher power signal.

During a plasma discharge, a discharge current channel is established between the second center electrode 50 and the streamer electrode 220, and accordingly the characteristics of an inductor are achieved when viewed from an electrical point of view.

Figure 8:
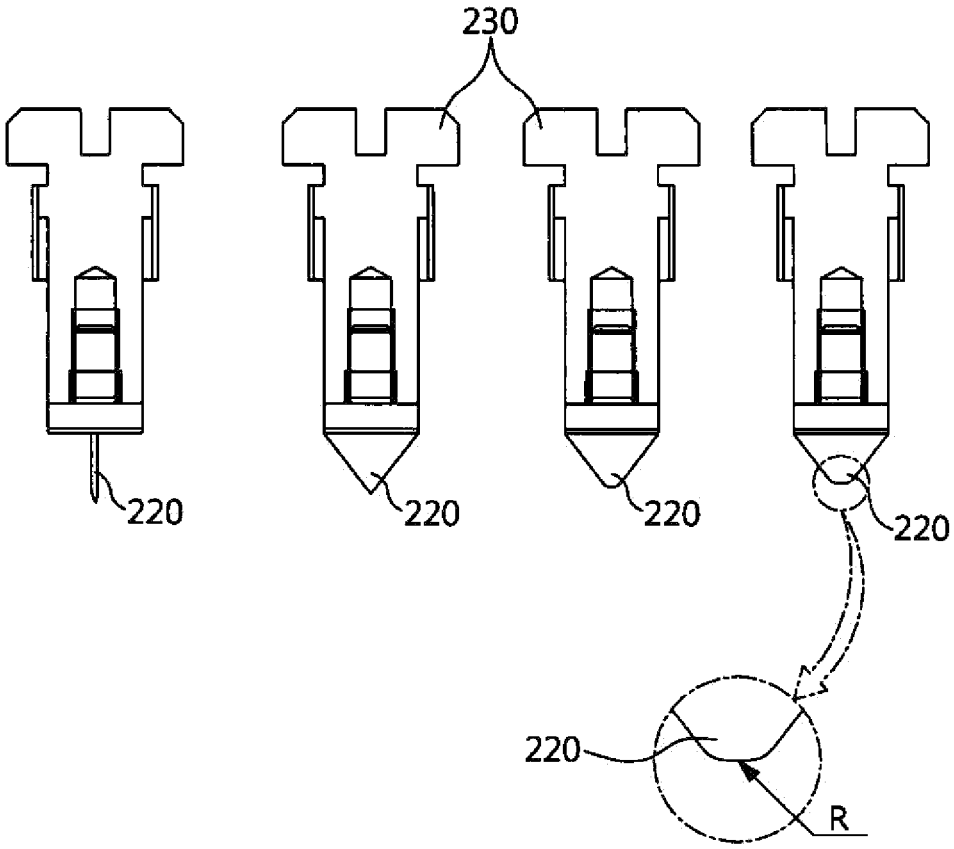
FIG. 8 is a diagram illustrating various examples of the streamer electrode.

FIG. 8 is a diagram illustrating various examples of the streamer electrode 220. The streamer electrode 220 may have a needle shape, a pointed cone shape, or a round cone shape.

The streamer electrode 220 having a needle shape is disadvantageous in that the tip thereof may be easily damaged by repeated discharges because it has poor durability, but is advantageous in that it generates the strongest induced electric field.

The streamer electrode 220 having a pointed cone shape is advantageous in that damage is of an intermediate level and thus the durability thereof is improved compared to the streamer electrode 220 having a needle shape. The streamer electrode 220 having a round cone shape generates a weaker induced electric field than the streamer electrode 220 having a needle shape, but has the advantage of the best durability.

In an embodiment including a plurality of streamer discharge modules 200, which will be described later, it is preferred that the streamer electrode 220 having a round cone shape be disposed in an input stage in which a high voltage is induced, the streamer electrode 220 having a pointed cone shape be disposed in an intermediate stage, and the streamer electrode 220 having a needle shape be disposed in a last stage.

The second center electrode 50 is coupled with the first center electrodes 40 by the fastening members 20 when the streamer discharge module 200 is coupled with the coaxial connectors 100.

Figure 5A:
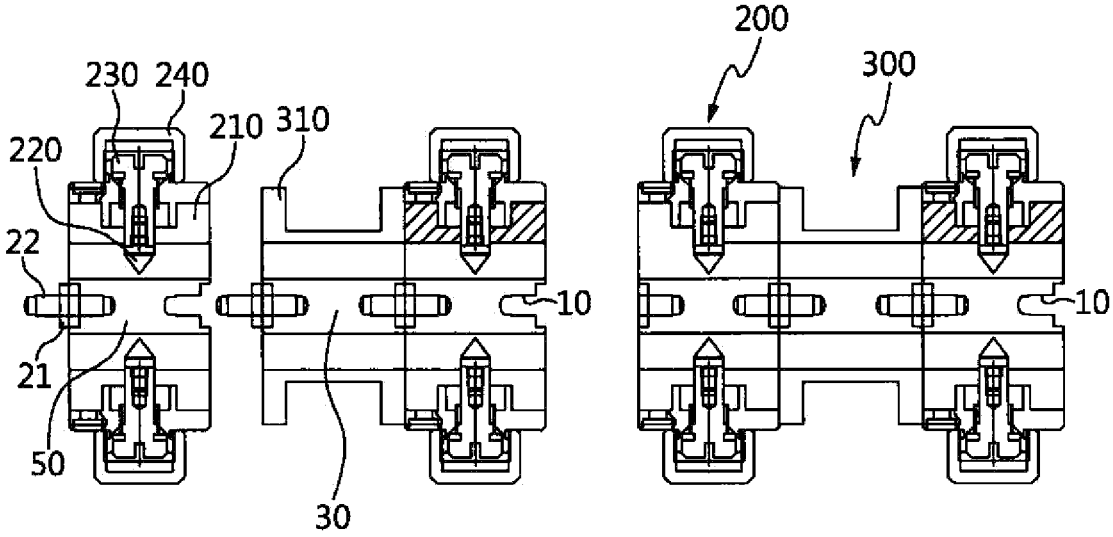
FIGS. 5A and 5B are diagrams of an embodiment in which a plurality of streamer discharge modules is combined together.

A headless bolt is used as the fastening member 20, so that the first center electrode 40 is coupled with the second center electrode 50 by rotating the coaxial connector 100 and the streamer discharge module 200 in opposite directions. A bushing 21 is provided between the first center electrode 40 and the second center electrode 50 as the fastening member 20 so that the headless bolt 22 is inserted into the bushing 21, thereby preventing deflection (refer to FIG. 5A).

In particular, in these embodiments of the present invention, the streamer electrode 220 is secured through the outer circumferential surface of the casing 210. The streamer electrode 220 includes a location adjustment bolt 230 fastened through the outer circumferential surface of the casing 210, and a cover 240 provided on the outer circumferential surface of the casing 210, and configured to surround the head of the location adjustment bolt 230 protruding through the outer circumferential surface of the casing 210.

A single streamer electrode 220 may be provided, as illustrated in FIG. 2A, or a pair of opposite streamer discharge modules 200 may be provided, as illustrated in FIG. 2B.

As described above, in accordance with embodiments of the present invention, a plurality of streamer electrodes 220 may be provided in a single streamer discharge module 200, or a plurality of streamer discharge modules 200 may be provided between a pair of coaxial connectors 100.

Figure 3:
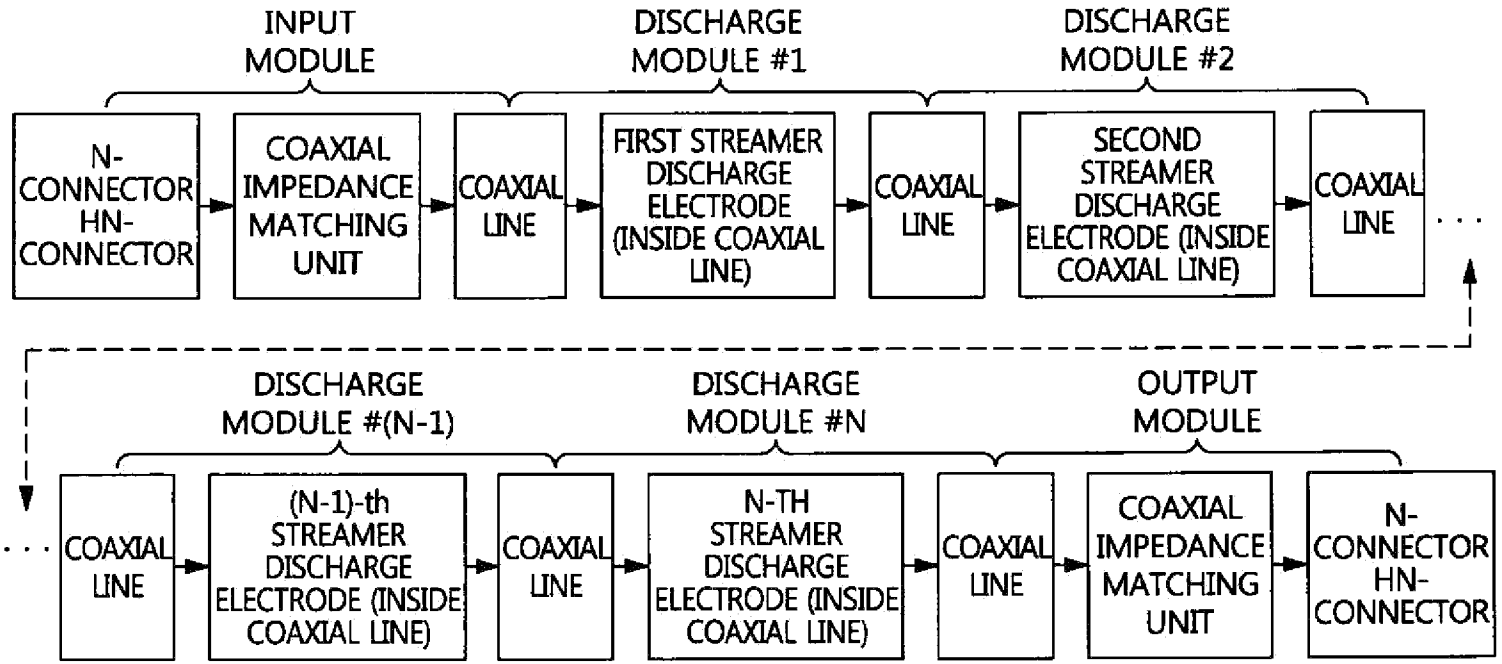
FIG. 3 is a configuration diagram of an embodiment in which power limiting performance is improved by combining a plurality of streamer discharge modules together.
Figure 4:
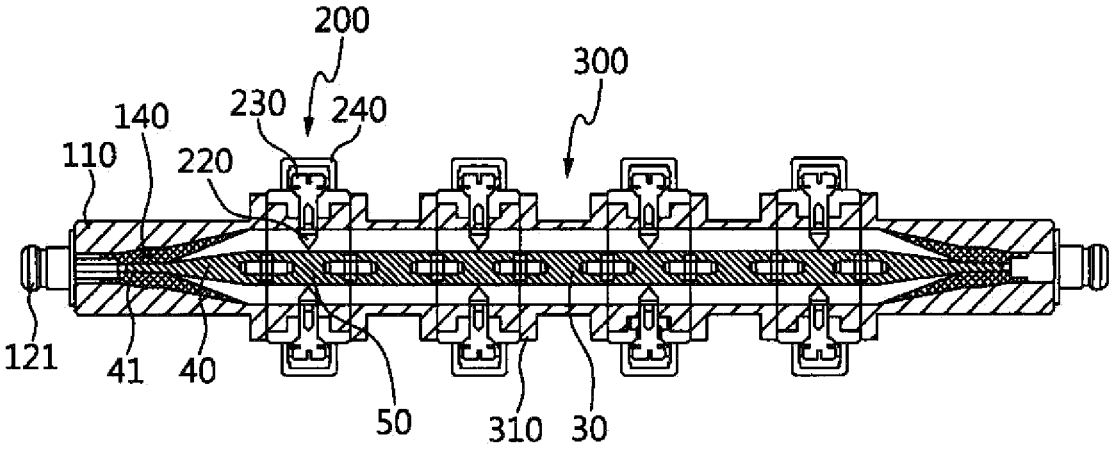
FIG. 4 is a diagram of an antenna line protection device having a plurality of streamer discharge modules.

FIG. 3 is a configuration diagram of an embodiment in which power limiting performance is improved by combining a plurality of streamer discharge modules 200 together, FIG. 4 is a diagram of an antenna line protection device having a plurality of streamer discharge modules 200, and FIG. 5 is a diagram of an embodiment in which a plurality of streamer discharge modules 200 is combined together.

In accordance with an embodiment of the present invention, a plurality of streamer discharge modules 200 configured to generate a streamer discharge are modularized, the plurality of streamer discharge modules 200 are connected in series between a pair of coaxial connectors 100, as illustrated in FIG. 3, thereby improving power limiting performance.

Figure 5B:
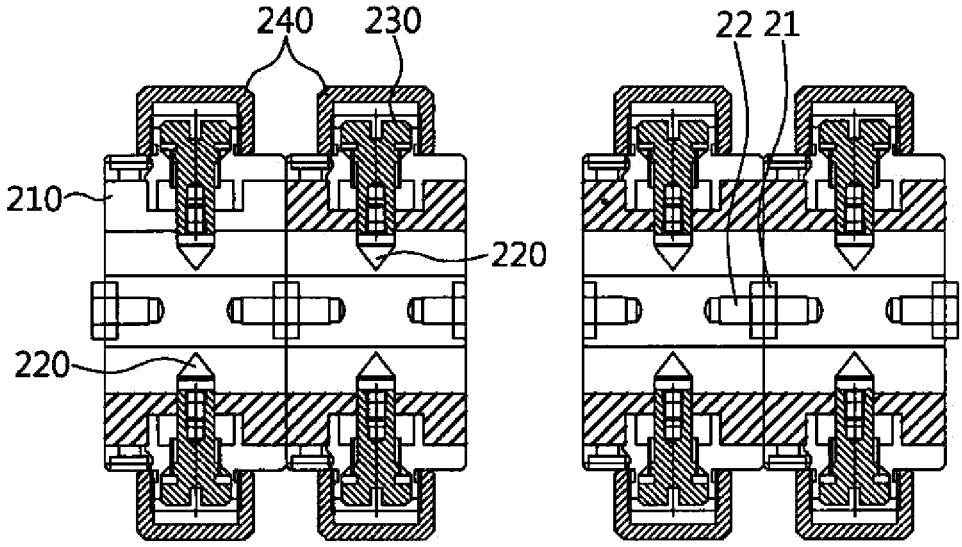

Meanwhile, when the length of the antenna line protection device is relatively short, as illustrated in FIG. 5B, the length of the antenna line protection device may be extended by disposing a spacing module 300 (see FIG. 5A) between a plurality of streamer discharge modules 200 that are connected in series.

The spacing module 300 includes a casing 310 that is configured such that the coaxial line 30 including the second center electrode 50 passes through the center of the spacing module 300 and the casing 310 surrounds the outer surface of the coaxial line 30.

Figure 6:
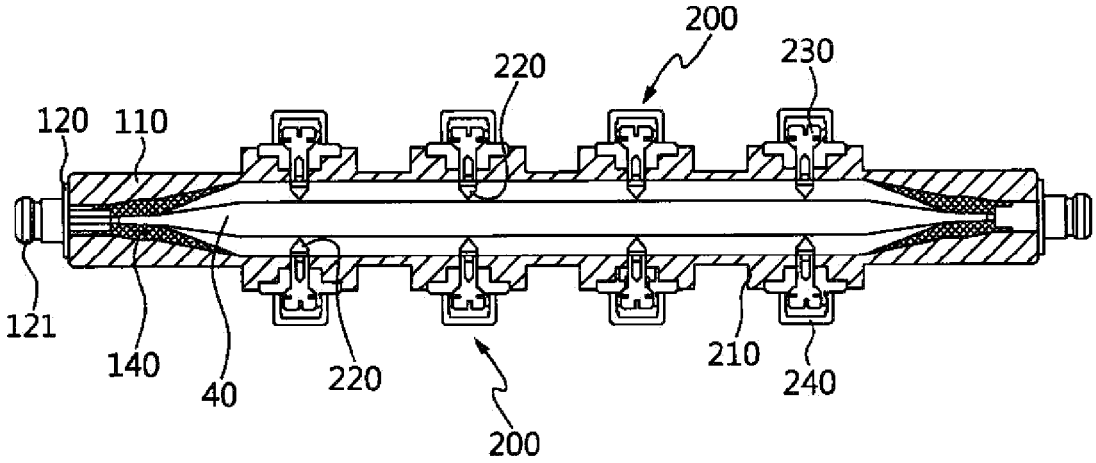
FIG. 6 is a diagram of an embodiment of an antenna line protection device in which a plurality of streamer discharge modules is integrated with a coaxial connector.

FIG. 6 is a diagram of an embodiment of an antenna line protection device in which a plurality of streamer discharge modules 200 is integrated with a coaxial connector 100. In this embodiment, the streamer discharge modules 200 are not modularized and the coaxial connector 100 is integrated with the streamer discharge modules 200, thereby providing a standardized antenna line protection device.

That is, this embodiment is intended to improve the suppression rate of pulses by increasing the number of streamer discharge modules 200 to N, and spacing modules 300 are disposed between the streamer discharge modules 200.

The distance between an (N−1)-th streamer electrode 220 and an N-th streamer electrode 220 is set to a distance in the range from a ¼ wavelength to a ½ wavelength in a use frequency band. The distances between first to N-th streamer electrodes 220 and second center electrodes 50 are set using location adjustment bolts 230 so that the distances gradually increase toward an input stage.

The reason for this is that, when a process in which pulses sequentially decrease is taken into account, pulse power applied to the first streamer electrode 220 is highest and the lowest pulse power is input to the last N-th streamer electrode 220.

Figure 7:
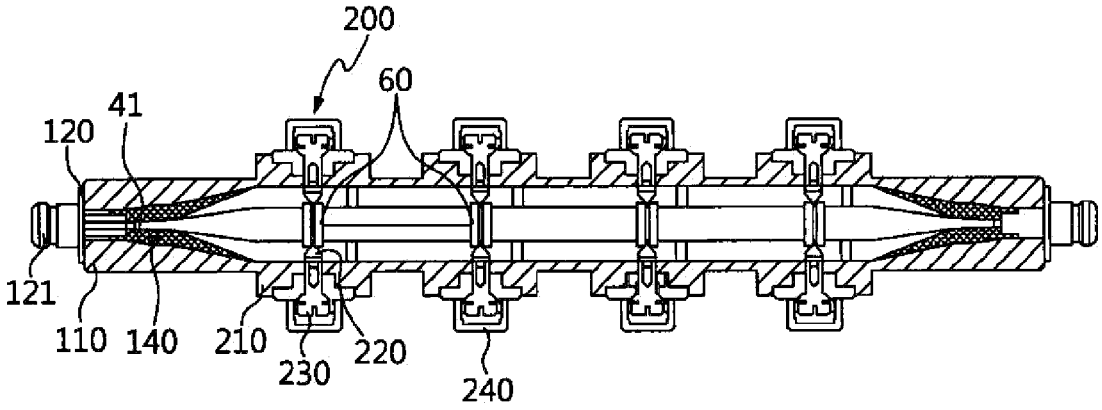
FIG. 7 is a diagram of dielectric rings that are provided around the outer surface of a center electrode.

FIG. 7 is a diagram of dielectric rings 60 that are provided around the outer surface of a center electrode.

In an antenna line protection device according to an embodiment of the present invention, a pair of donut-shaped dielectric rings 60 are provided around the outer surface of the second center electrode 50 to be spaced apart from each other, and are provided such that the tips of the streamer electrodes come into contact the pair of dielectric rings 60.

The reason why the dielectric rings 60 are employed is that, when an excessive high-power electromagnetic pulse is input to a coaxial connector 100, it is possible to use the surface discharge of the dielectric ring 60 instead of an air insulation breakdown phenomenon.

Although a dielectric generally has a dielectric strength equal to or higher than several kV/mm with respect to applied DC voltage, the same dielectric rings 60 may be subjected to insulation breakdown at a voltage lower than the insulation breakdown voltage of air, that is, about 3 kV/mm.

In the above-described antenna line protection device according to this embodiment of the present invention, the strength and response time of an induced electric field may be varied by adjusting the gap between the second center electrode 50 and the streamer electrode 220 using the shape of the streamer electrode 220 and the location adjustment bolt 230.

That is, a high electric field can be induced within a fast response time in proportion to the degree of sharpness of the streamer electrode 220, with the result that an advantage arises in that a discharge current channel can be established using a low power strength.

If the streamer electrode 220 does not have a needle shape, the gap between the streamer electrode 220 and the second center electrode 50 may be reduced using the location adjustment bolt 230, and thus a discharge current channel can be established using a low power strength.

Meanwhile, if the gap between the streamer electrode 220 and the second center electrode 50 is fixed, the inside of the antenna line protection device may be maintained at a pressure higher than an atmospheric pressure by injecting nitrogen mixture gas thereto in order to establish a discharge current channel using a low power strength.

Figure 9:
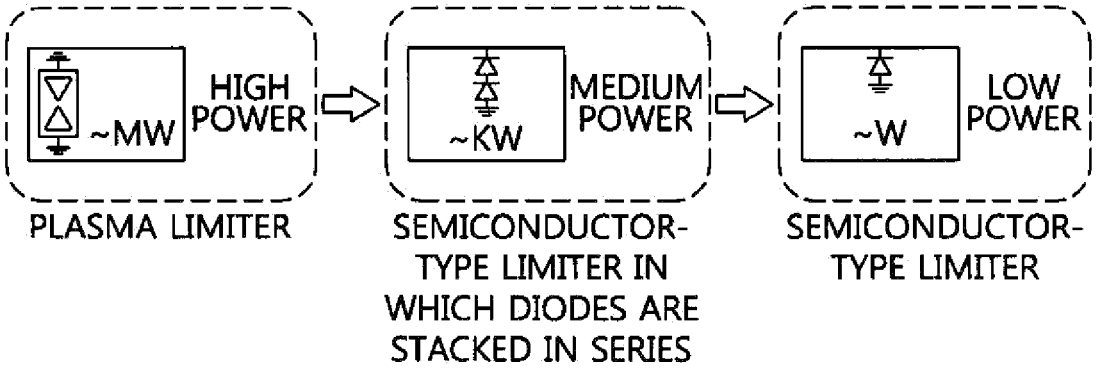
FIG. 9 is a block diagram illustrating a configuration that is capable of significantly improving suppression rate by using an additional semiconductor-type limiter in a rear stage when the output power of the antenna line protection device of the present invention is higher than a level at which the RF device of an antenna line can be protected.

FIG. 9 is a block diagram illustrating a configuration that is capable of significantly improving suppression rate by using an additional semiconductor-type limiter in a rear stage when the output power of the antenna line protection device of the present invention is higher than a level at which the RF device of an antenna line can be protected.

The operating power level of the antenna line protection device according to an embodiment of the present invention, which is located in the front stage of the block diagram of FIG. 9, is in the range from higher than 100 kW to lower than 10 MW, and can thus perform a limiter operation in a power range in which an operation cannot be performed using a semiconductor-type limiter diode. The semiconductor limiter located at the rear stage of the block diagram of FIG. 9 is configured to receive an output pulse of 100 kW or less attenuated by the antenna line protection device located in the front stage and to make the pulse lower than the dielectric strength of electronic device, such as a transistor.

In this case, the power limit of a limiter that can be fabricated using a commercial diode is about 1 kW. There may be a case where an intermediate power-level limiter that can operate in the range from higher than 1 kW to lower than 100 kW is required. Since such an intermediate power-level limiter cannot be implemented using a commercial single diode chip, an operating power level may be increased using a method in which diodes are stacked in series, as illustrated in the middle part of the block diagram of FIG. 9.

Figure 10:
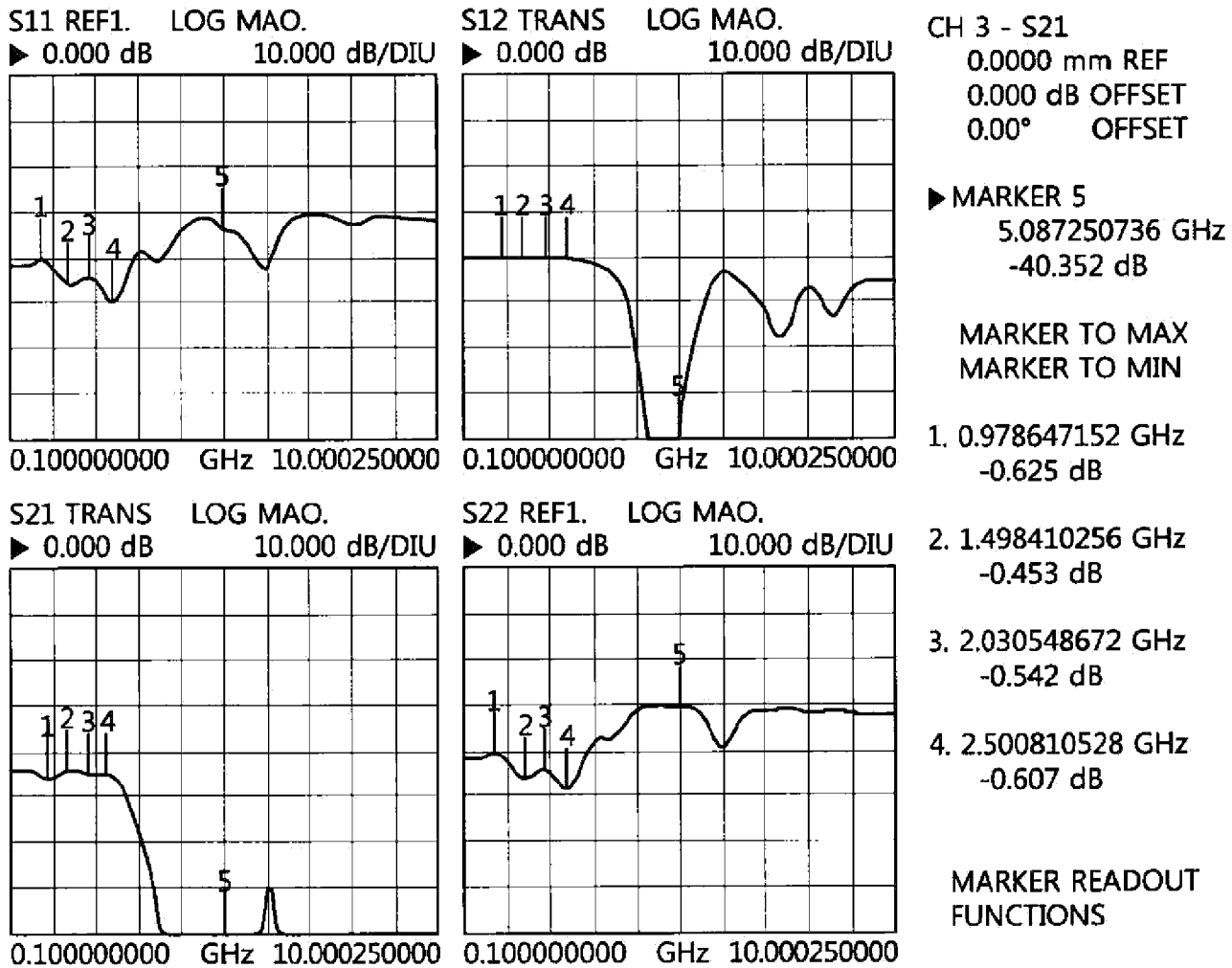
FIG. 10 shows graphs illustrating the frequency response characteristics of an antenna line protection device according to an embodiment of the present invention.

FIG. 10 shows graphs illustrating the frequency response characteristics of an antenna line protection device according to an embodiment of the present invention.

FIG. 10 shows graphs illustrating the input/output impedance characteristics of the antenna line protection device according to this embodiment of the present invention. In this drawing, small signal S-parameters measured using a network analyzer are plotted on the graphs.

From this drawing, it can be seen that performance having an input/output reflection loss (indexes: S11, and S22) lower than 10 dB and an insertion loss (indexes: S12, and S21) lower than 1 dB was achieved in a frequency band higher than 0 and lower than 2.5 GHz. Accordingly, it can be seen that even when the antenna line protection device according to this embodiment of the present invention was installed between the antenna of a wireless communication device and the receiver or transmitter thereof, impedance and loss were not significantly increased.

FIG. 11 is a diagram illustrating the performance of suppressing damped sinusoidal (DS) pulses when four streamer discharge modules 200 are used.

Figure 11A:
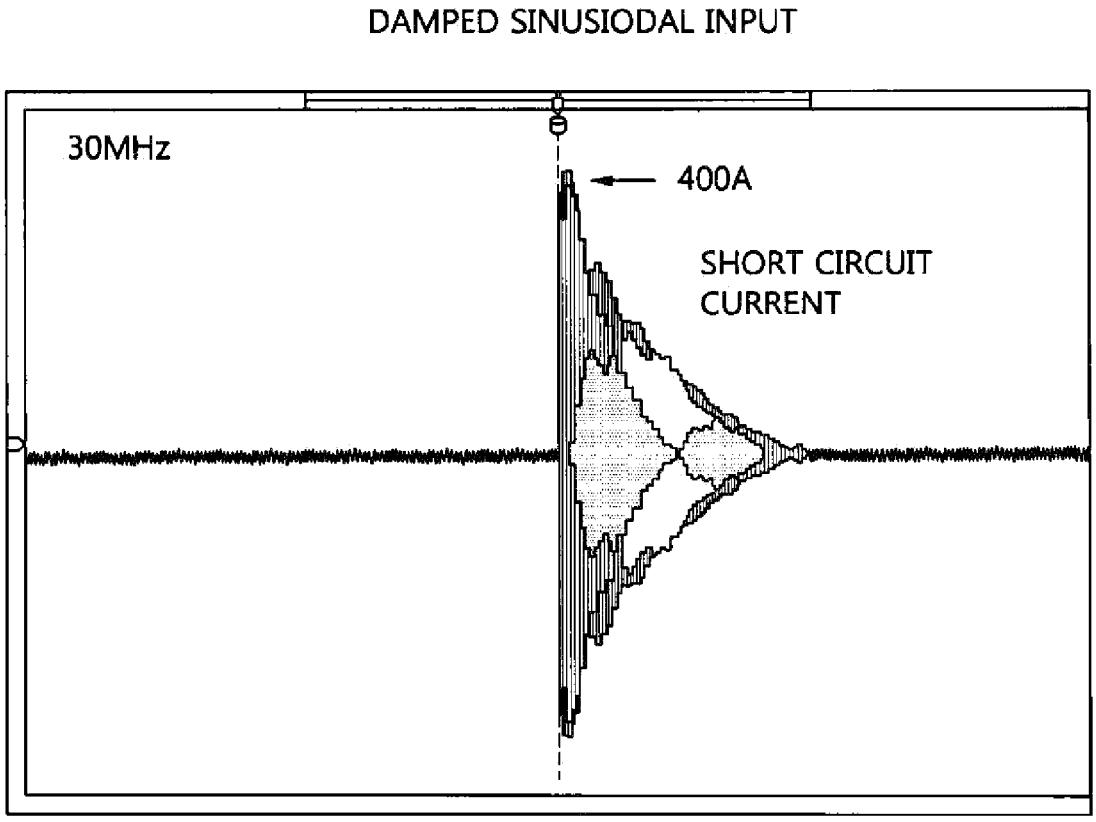
FIGS. 11A and 11B are diagrams illustrating the performance of suppressing damped sinusoidal (DS) pulses when four streamer discharge modules 200 are used.
Figure 11B:
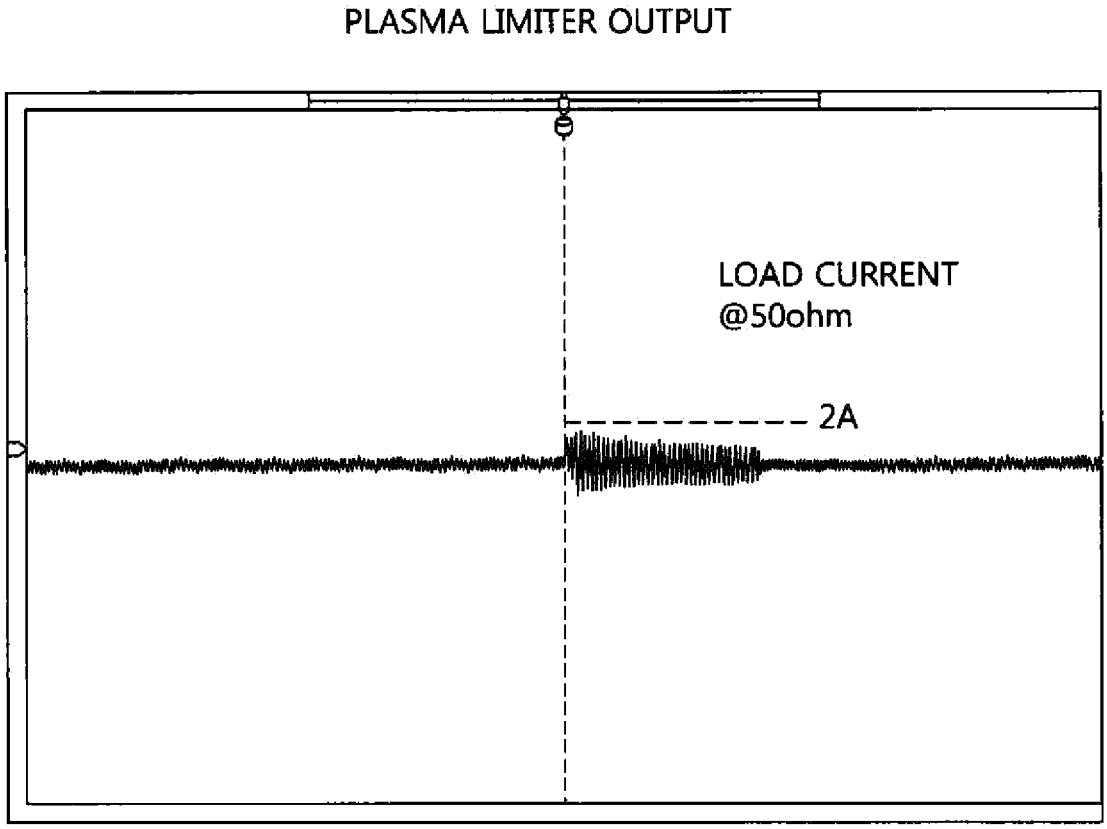

From FIG. 11, it can be seen that when a damped vibration waveform pulse of short circuit current 400A is input to an antenna line protection device according to an embodiment of the present invention (FIG. 11A), the maximum magnitude of current measured in a 50 ohm load condition does not exceed 2 A (FIG. 11B).

That is, it can be seen that among the factors of an HEMP test, the requirements of a conductive pulse current injection test could be satisfied when a semiconductor limiter was provided in a rear stage.

Figure 12:
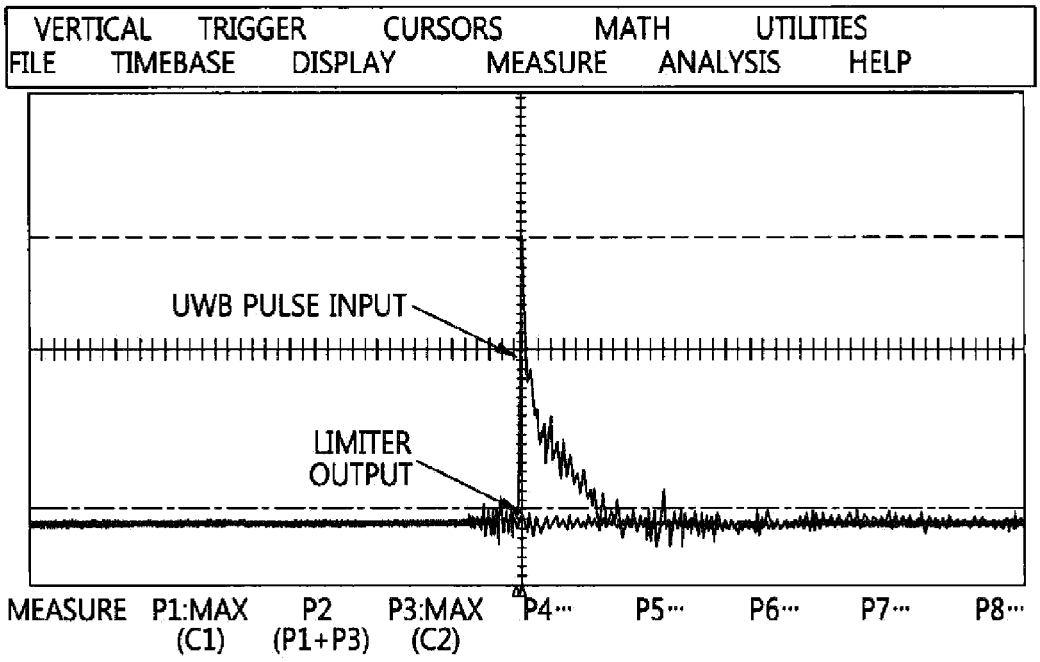
FIG. 12 is a diagram illustrating the performance of suppressing ultra wideband (UWB) pulses when four streamer discharge modules are used.

FIG. 12 is a diagram illustrating the performance of suppressing UWB pulses when four streamer discharge modules 200 were used.

FIG. 12 illustrates the case where a UWB monopulse was input to an antenna line protection device according to an embodiment of the present invention, unlike the case of FIG. 11. In this case, it can be seen that a several MW-level input pulse (having several kV or higher, and 50 ohm load) could be suppressed to a kW level, thereby achieving the advantage of effectively blocking a monopulse input having a fast rise time.

That is, it can be seen that a sufficiently fast response time could be achieved using the antenna line protection device according to this embodiment of the present invention even when a UWB monopulse was input.

At least one embodiment of the present invention has the advantage of providing an antenna line protection device that includes a streamer discharge module coupled between a pair of coaxial connectors and configured to suppress an excessive input pulse, thereby achieving a discharge tube response speed equal to or shorter than a nanosecond.

At least one embodiment of the present invention has the advantage of providing an antenna line protection device in which a cone-shaped impedance matching unit is disposed inside the coaxial connector between the inner circumferential surface of a through hole and the outer circumferential surface of a first center electrode, thereby overcoming impedance mismatch between a commercial N-connector using a dielectric, such as a Teflon, and a coaxial line using air as a dielectric.

At least one embodiment of the present invention has the advantage of providing an antenna line protection device in which modularized streamer discharge modules configured to generate a streamer discharge are provided, thereby enabling a plurality of modularized streamer discharge modules to be disposed between a pair of coaxial connectors.

Although the preferred embodiments of the present invention have been disclosed for illustrative purposes, those skilled in the art will appreciate that various modifications, additions and substitutions are possible without departing from the scope and spirit of the invention as disclosed in the accompanying claims.

What is claimed is:

1. An antenna line protection device, comprising:

a pair of coaxial connectors disposed on both side ends of the antenna line protection device; and a streamer discharge module coupled between the coaxial connectors so that, when a pulse signal is input via the coaxial connectors, the streamer discharge module induces an electric field and thus establishes a discharge current channel, thereby suppressing an excessive input pulse, wherein each of the coaxial connectors comprises:

a body part provided with a through hole extending from a first end of the body part through the body part to a second end thereof, and a flange extending along an outer periphery of the second end of the body part;

an input/output interface part provided at the first end of the body part, and provided with a connector protruding in a direction corresponding to that of the body part;

a dielectric part formed to protrude from the input/output interface part in a direction corresponding to that of the connector and to be inserted into a first end of the through hole; and a first center electrode disposed inside the through hole, formed to extend in a longitudinal direction of the through hole, and configured such that a first end of the first center electrode is connected to the dielectric part and a fastening hole is formed at a second end of the first center electrode to allow a fastening member to be fastened into the fastening hole, wherein the through hole is formed in a tapered shape such that a diameter thereof remains uniform through a portion near the first end of the body part and then increases in a direction toward the second end of the body part, and wherein the first center electrode is formed in a tapered shape such that a diameter thereof remains uniform and then increases in a direction toward a second end thereof.

2. The antenna line protection device of claim 1, wherein the dielectric part is configured such that a portion of the dielectric part to which the first center electrode is connected is stepped and protrudes.

3. The antenna line protection device of claim 1, further comprising an impedance matching part, the impedance matching part being provided such that an outer circumferential surface thereof comes into close contact with a circumferential surface of the through hole, a first end of an inner circumferential surface thereof surrounds the first end of the first center electrode, and a second end of the inner circumferential surface thereof is spaced apart from the first center electrode and forms a space along with the second end of the first center electrode.

4. The antenna line protection device of claim 1, further comprising a connection portion configured to protrude from the first end of the first center electrode and to be inserted into the dielectric part.

5. The antenna line protection device of claim 4, wherein the connection portion has a cross-shaped section.

6. The antenna line protection device of claim 1, wherein the streamer discharge module comprises:

a casing configured such that a coaxial line is disposed across a center thereof; and a streamer electrode provided inside the casing to be spaced apart from a second center electrode of the coaxial line.

7. The antenna line protection device of claim 6, wherein the streamer electrode comprises:

a location adjustment bolt fastened through an, outer circumferential surface of the casing; and a cover provided on the outer circumferential surface of the casing, and configured to surround a head of the location adjustment bolt protruding through the outer circumferential surface of the casing.

8. The antenna line protection device of claim 6, further comprising a pair of donut-shaped dielectric rings provided around the outer surface of the second center electrode to be spaced apart from each other and provided such that tips of the streamer electrodes come into contact the pair of dielectric rings.

9. The antenna line protection device of claim 6, wherein the streamer electrode has a cone shape so that a tip of the streamer electrode proximate to the second center electrode has a gradually curved shape.

10. The antenna line protection device of claim 6, wherein the streamer electrode has a needle shape.

11. The antenna line protection device of claim 1, wherein the streamer discharge module comprises a plurality of streamer discharge modules between the pair of coaxial connectors.

12. The antenna line protection device of claim 11, further comprising a spacing module configured to space a plurality of streamer discharge module apart from each other and provided between each pair of the plurality of streamer discharge modules.

13. The antenna line protection device of claim 12, wherein the spacing module comprises a casing that is configured such that a coaxial line including a second center electrode passes through a center of the spacing module and the casing surrounds an outer surface of the coaxial line.

* * * * *